US011471928B2

(12) United States Patent
Fujimoto et al.

(10) Patent No.: US 11,471,928 B2
(45) Date of Patent: Oct. 18, 2022

(54) POSITIONING DEVICE FOR HOT STAMPING

(71) Applicant: TOPRE CORPORATION, Tokyo (JP)

(72) Inventors: Satoshi Fujimoto, Sagamihara (JP); Shu Kato, Sagamihara (JP)

(73) Assignee: TOPRE CORPORATION, Tokyo (JP)

( * ) Notice: Subject to any disclaimer, the term of this patent is extended or adjusted under 35 U.S.C. 154(b) by 0 days.

(21) Appl. No.: 17/540,276

(22) Filed: Dec. 2, 2021

(65) Prior Publication Data

US 2022/0234091 A1 Jul. 28, 2022

(30) Foreign Application Priority Data

Jan. 22, 2021 (JP) ..... JP2021-008655

(51) Int. Cl.
*B21D 43/00* (2006.01)
*B21D 22/02* (2006.01)

(52) U.S. Cl.
CPC ..... *B21D 43/003* (2013.01); *B21D 22/022* (2013.01)

(58) Field of Classification Search
CPC ... B21D 43/003; B21D 22/022; B21D 28/265
See application file for complete search history.

(56) References Cited

U.S. PATENT DOCUMENTS 5,722,648 A * 3/1998 Groll ..... B23Q 3/18 269/47
2004/0070130 A1* 4/2004 Pavlik ..... B25B 5/061 269/32
2014/0157857 A1* 6/2014 Breen ..... B23P 15/24 72/404

FOREIGN PATENT DOCUMENTS

JP 2006-224105 A 8/2006
JP 2006224105 A * 8/2006 ..... B21D 43/26

* cited by examiner

*Primary Examiner* — David P Bryant
*Assistant Examiner* — Christine Bersabal
(74) *Attorney, Agent, or Firm* — Metrolex IP Law Group, PLLC

(57) ABSTRACT

A positioning device for hot stamping includes a pilot pin and a driving mechanism for driving the pilot pin. Before a plate material is placed into a press die, when the driving mechanism positions the pilot pin at a predetermined projecting position, a tip portion of the pilot pin projects from a pin guide hole and a body portion of the pilot pin formed further toward a base end side than the tip portion projects from the pin guide hole. Before a process in which the press die removes heat from the plate material after having been press-formed by the press die, when the driving mechanism positions the pilot pin at a predetermined immersed position, the body portion of the pilot pin is immersed in the pin guide hole while only the tip portion of the pilot pin projects from the pin guide hole.

4 Claims, 5 Drawing Sheets

POSITIONING DEVICE FOR HOT STAMPING

CROSS REFERENCE TO RELATED APPLICATION

This application is based upon and claims the benefit of priority under 35 U.S.C. § 119 from Japanese Patent Application No. 2021-008655 filed on Jan. 22, 2021, the entire contents of which are incorporated herein by reference.

TECHNICAL FIELD

The present invention relates to a positioning device for hot stamping.

BACKGROUND

In recent years, in order to improve the fuel efficiency of automobiles, further weight reduction of automobile frame parts such as pillars, side sills, and roof rails is desired, and hot stamping using ultra-high tensile steel plates (ultra-high tensile material) is often used.

Hot stamping is also referred to as hot pressing, or hot forming. Products after hot stamping are very hard, and thus it is difficult to perform press processing such as piercing in the subsequent process. Since piercing is usually performed before hot stamping, the positional accuracy of a pilot hole (positioning hole) in performing hot stamping is important.

SUMMARY

However, when a plate material (blank material) is heated to a high temperature, the plate material expands due to heating, and shrinks due to heat removal (cooling) after hot stamping, and thus it is difficult to maintain the positional accuracy of a pilot hole in performing press processing such as piercing.

As a method for positioning a plate material in hot stamping, Japanese Patent Application Laid-Open No. 2006-224105 discloses that a plate material in a heated state is primarily positioned with respect to a lower pressing die by a nesting mechanism, and then a conical first position adjusting pin and a quadrangular pyramid second position adjusting pin are projected from the lower die, and the plate material is secondarily positioned precisely with respect to the lower pressing die by the pins being engaged with holes previously formed in the plate material.

In the method described in Japanese Patent Application Laid-Open No. 2006-224105, the positional accuracy of the plate material is improved by the nesting mechanism and the positioning pins (pilot pins) projecting from the lower die. However, in this method, the plate material shrinks due to heat removal therefrom after having been press-formed by the die, and in order to prevent guide holes in the plate material from consequently biting into the pilots pins, all of the pilot pins are immersed in the die, and thus the plate material may deviate on the die due to the shrinkage caused by heat removal. When the plate material deviates on the die due to shrinkage caused by heat removal, for example, a conveying jaw (conveying robot) cannot clamp a product formed by hot stamping, which may cause a transfer error.

Accordingly, an object of the present invention is to provide a positioning device for hot stamping capable of preventing a plate material press-formed by a die from biting into pilot pins due to shrinkage caused by heat removal, and from deviating on the die during a lifting operation.

A positioning device for hot stamping according to an embodiment of the present invention includes a pilot pin provided in a pin guide hole in a press die, and a driving mechanism configured to drive the pilot pin. Before a plate material is placed into the press die, when the driving mechanism positions the pilot pin at a predetermined projecting position, a tip portion of the pilot pin projects from the pin guide hole and a body portion of the pilot pin formed further toward a base end side than the tip portion projects from the pin guide hole. Before a process in which the press die removes heat from the plate material after having been press-formed by the press die, when the driving mechanism positions the pilot pin at a predetermined immersed position, the body portion of the pilot pin is immersed in the pin guide hole while only the tip portion of the pilot pin projects from the pin guide hole.

A positioning device for hot stamping according to an embodiment of the present invention makes it possible to prevent a plate material press-formed by a die from biting into pilot pins due to shrinkage caused by heat removal, and from deviating on the die during a lifting operation.

DETAILED DESCRIPTION

An embodiment of the present invention will be described in detail with reference to the drawings.

Configuration of Positioning Mechanism for Hot Stamping

Figure 1:
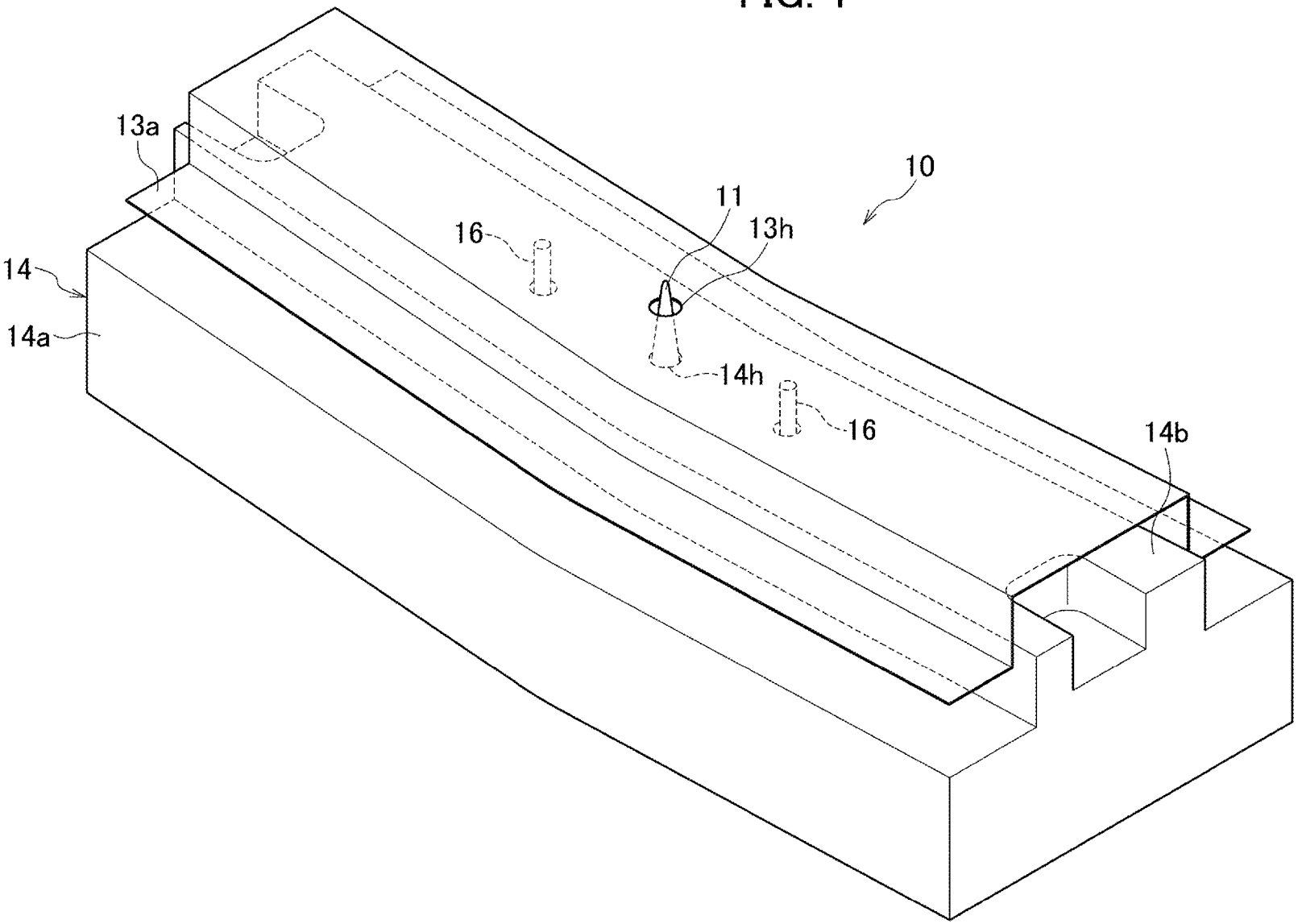
FIG. 1 is a perspective view showing an outline of a positioning device for hot stamping according to an embodiment of the present invention.
Figure 2:
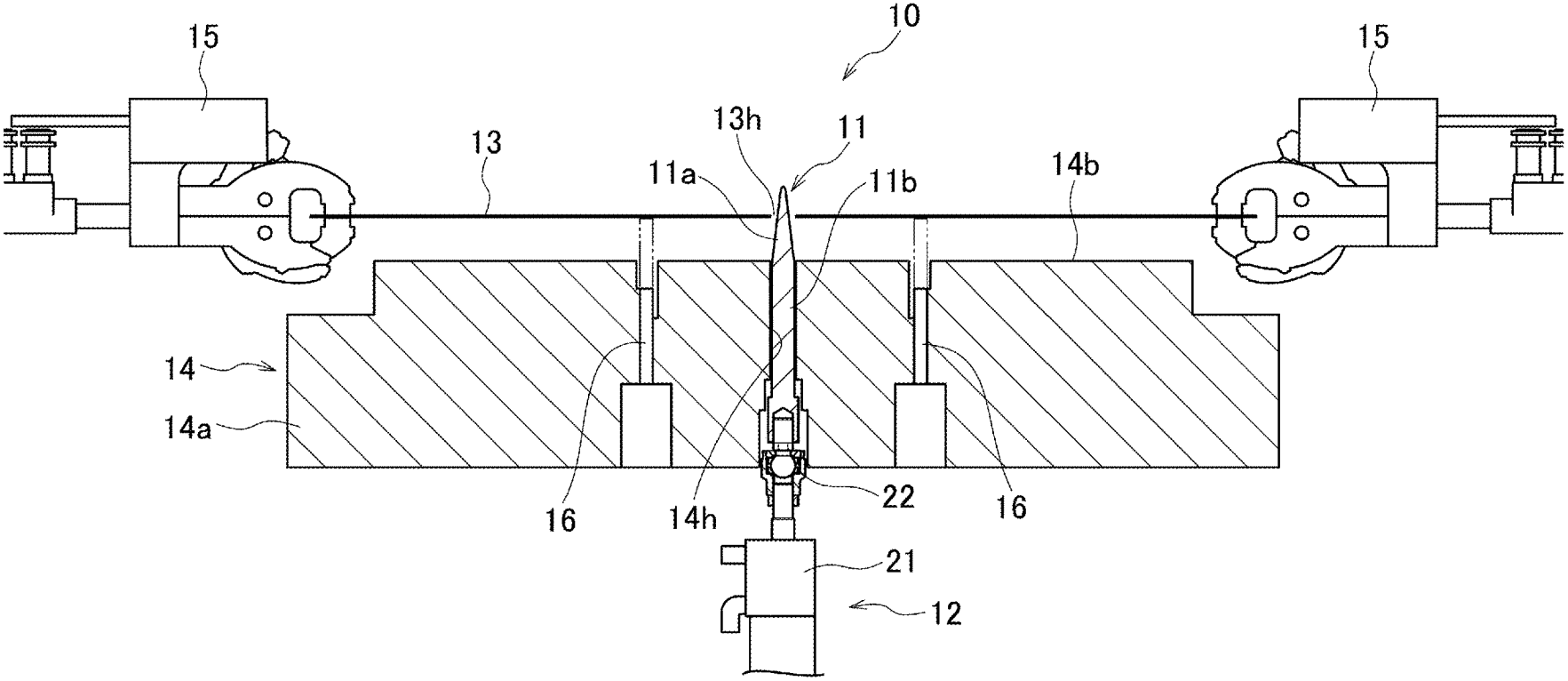
FIG. 2 is a side cross-sectional view showing an outline of the positioning device for hot stamping according to an embodiment of the present invention.

As shown in FIGS. 1 and 2, a positioning device for hot stamping (hereinafter, simply referred to as a "positioning device") 10 according to the present embodiment includes a pilot pin (movable pilot pin) 11 and a drive mechanism 12.

A nest (fixed nest, not shown in the figure) and the pilot pin 11 are used for positioning a plate material (blank material) 13 in hot stamping according to the present embodiment.

The nest is a simple fixed nest and is a position guide for the plate material 13 in hot stamping.

Normally, heat removal by a press die 14 after hot stamping causes a change in the shrinkage state of a press-formed plate material 13*a*, and thus accurate positioning of the plate material 13 is difficult by using only the nest. In particular, since the amount of change in the plate material 13 in the longitudinal direction is large, it is difficult to form the plate material 13 in a correct position and shape. In the present embodiment, the nest serves as a guide for preventing the plate material 13 press-formed by the press die 14 from moving in the in-plane direction at the time of removing heat.

The pilot pin 11 is a movable pilot pin, and one is disposed near the center of a lower die 14*a* of the press die 14 where there is little influence of heat removal shrinkage when the plate material 13 is formed by the press die 14. When the plate material 13 is oblong, two pilot pins 11 may be disposed. In such a case, a guide hole 13*h* in the plate material 13 for one pilot pin 11 is a round hole, and a guide hole 13*h* in the plate material 13 for the other pilot pin 11 is an oblong hole. Even when two pilot pins 11 are disposed, a movable pilot pin is used for both of the two pilot pins 11.

In hot stamping, the positioning of the plate material 13 is basically performed by the pilot pin 11, and the nest is simply a guide for preventing the movement of the plate material 13.

The pilot pin 11 has a tip portion 11*a* formed into a conical shape having a rounded cross-section, and a body portion (root portion) 11*b* formed into a cylindrical shape. The body portion 11*b* is formed further toward a base end side than the tip portion 11*a*.

The tip portion 11*a* has a tip cross-section formed into a rounded shape in order for the pilot pin 11 to be easily inserted into the guide hole 13*h* in the plate material 13, and the body portion 11*b* is formed into a cylindrical shape for accurate positioning of the plate material 13.

In the shape of the pilot pin 11, the tip portion 11*a* may be formed into a pyramidal shape, and the body portion 11*b* formed further toward the base end side than the tip portion 11*a* may be formed into a prismatic shape.

The size of the pilot pin 11 is appropriately set in accordance with the size of a formed product, the amount by which the formed product is lifted up, and the thickness of the press die 14 (lower die 14*a*) through which the pilot pin 11 vertically slides.

The overall length of the pilot pin 11 is about 250 mm to 350 mm.

The length of the conical tip portion 11*a* is about 120 mm to 130 mm.

The length of the cylindrical body portion 11*b* is obtained by subtracting the length of the conical tip portion 11*a* from the overall length of the pilot pin 11.

The cylindrical body portion 11*b* has a diameter of about 20 mm.

The pilot pin 11 that slides vertically along a pin guide hole 14*h* is in a steady state (projecting state) when it is lifted up by an air cylinder 21 described later. At this time, the pilot pin 11 is lifted up to a position (projecting position) where a boundary section 11*c* between the conical tip portion 11*a* and the cylindrical body portion 11*b* projects about 10 mm from an upper surface 14*b* of the lower die 14*a* (see FIGS. 4 and 5). That is, at this time, the pilot pin 11 is lifted up such that the tip portion 11*a* and a part of the body portion 11*b* project from the pin guide hole 14*h*.

On the other hand, a state in which the body portion 11*b* of the pilot pin 11 is immersed in the pin guide hole 14*h* of the lower die 14*a* is an immersed state. At this time, the pilot pin 11 is lowered down to a position (immersed position) where the boundary section 11*c* between the conical tip portion 11*a* and the cylindrical body portion 11*b* is immersed about 5 mm from the upper surface 14*b* of the lower die 14*a* (see FIGS. 6 and 7). That is, at this time, the pilot pin 11 is lowered down such that the cylindrical body portion 11*b* is immersed in the pin guide hole 14*h* and only the conical tip portion 11*a* projects from the pin guide hole 14*h*.

Figure 4:
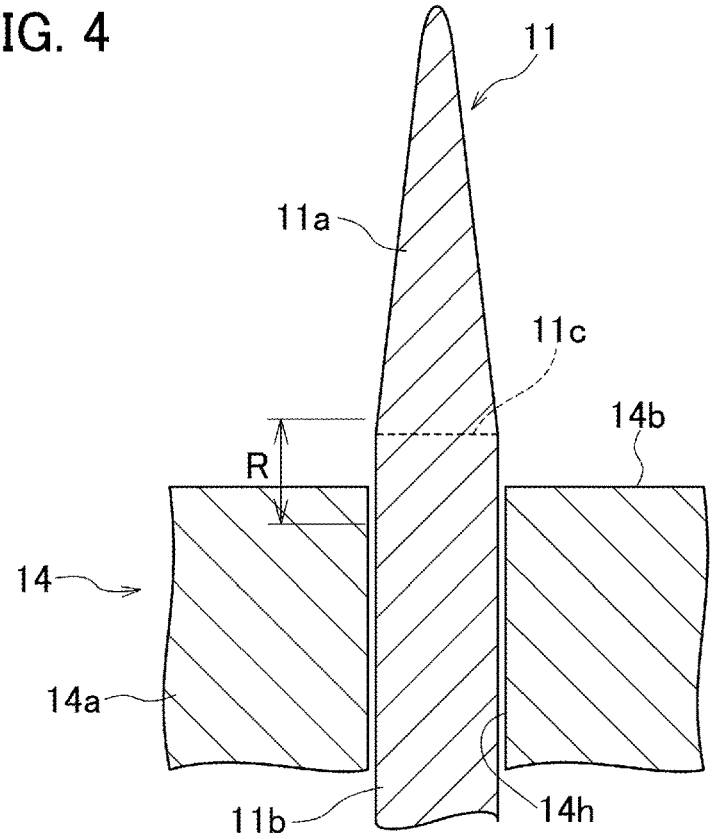
FIG. 4 is a diagram showing a relationship between a hot stamping process and a position of a pilot pin.

Therefore, a range of motion R of the pilot pin 11 from the steady state (projecting position) to the immersed state (immersed position) is about 15 mm (see FIG. 4).

The diameter of the guide hole 13*h* in the plate material 13 at normal temperature is set to +0.2 mm of the diameter of the body portion 11*b* of the pilot pin 11. For example, when the diameter of the cylindrical body portion 11*b* is 19.8 mm, the diameter of the guide hole 13*h* in the plate material 13 at normal temperature is set to 20 mm.

The plate material 13, which is heated to the austenite region (about 930 degrees Celsius), expands by about 1% with respect to the plate material 13 at normal temperature. Accordingly, the guide hole 13*h* in the plate material 13 having a diameter of 20 mm increases by about 0.2 mm in diameter by heating. That is, in the steady state (projecting position) of the pilot pin 11, a gap G1 of 0.2 mm is formed between the body portion 11*b* of the pilot pin 11 and the guide hole 13*h* in the heated plate material 13 (see FIG. 5).

Figure 6:
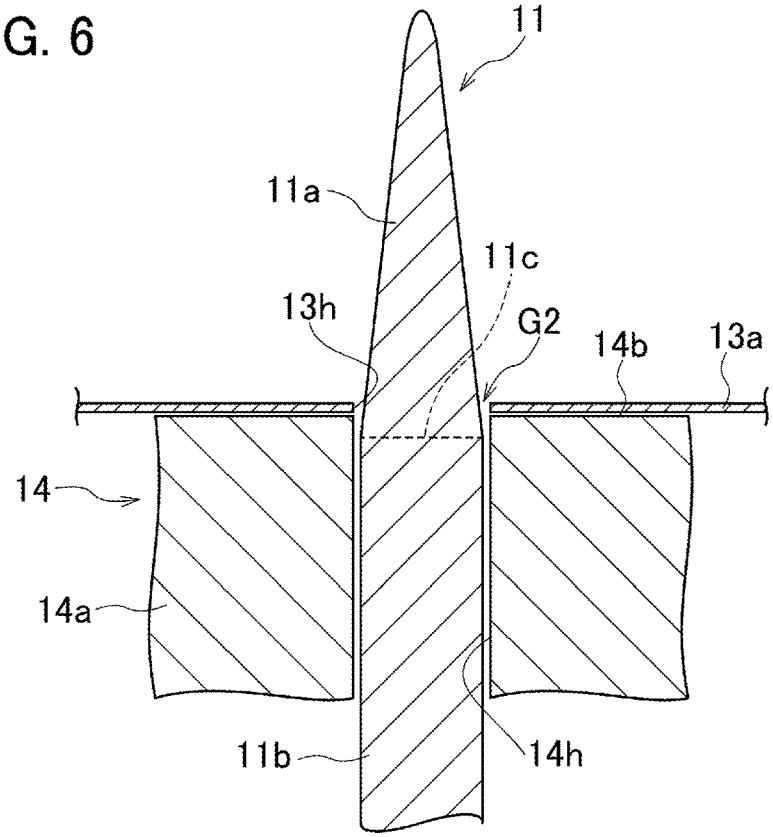
FIG. 6 is a diagram showing a relationship between the hot stamping process and a position of the pilot pin.
Figure 7:
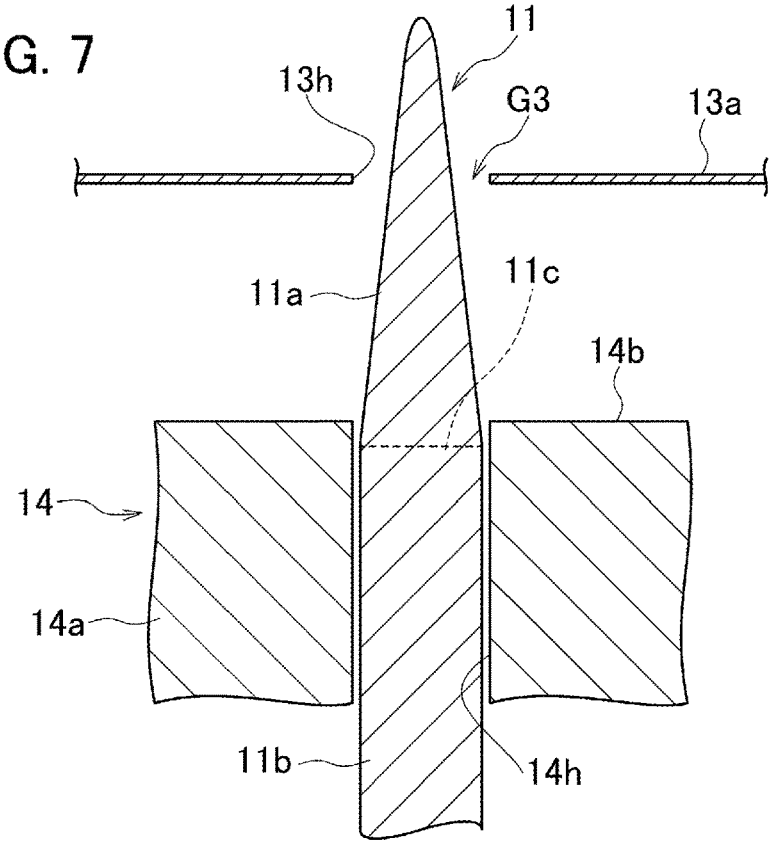
FIG. 7 is a diagram showing a relationship between the hot stamping process and a position of the pilot pin.

Meanwhile, in an immersed state of the pilot pin 11 (immersed position), the entire pilot pin 11 is not immersed in the pin guide hole 14*h* in the lower die 14*a*, and the body portion 11*b* and a part of the tip portion 11*a* are immersed in the pin guide hole 14*h* (see FIGS. 6 and 7). In the immersed state of the pilot pin 11, a gap G2 of about 0.5 mm is formed between the tip portion 11*a* of the pilot pin 11 and the guide hole 13*h* in the press-formed plate material 13*a* (see FIG. 6).

Further, when the press-formed plate material 13*a* is lifted to be taken out, a gap G3 of about 2.0 mm to 3.0 mm exists between the tip portion 11*a* of the pilot pin 11 and the guide hole 13*h* in the press-formed plate material 13*a* (see FIG. 7).

The pilot pin 11 is located in a cooled portion of the press die 14, and is thereby not being heated. In addition, the size (diameter) of the pilot pin 11 hardly changes.

Figure 3:
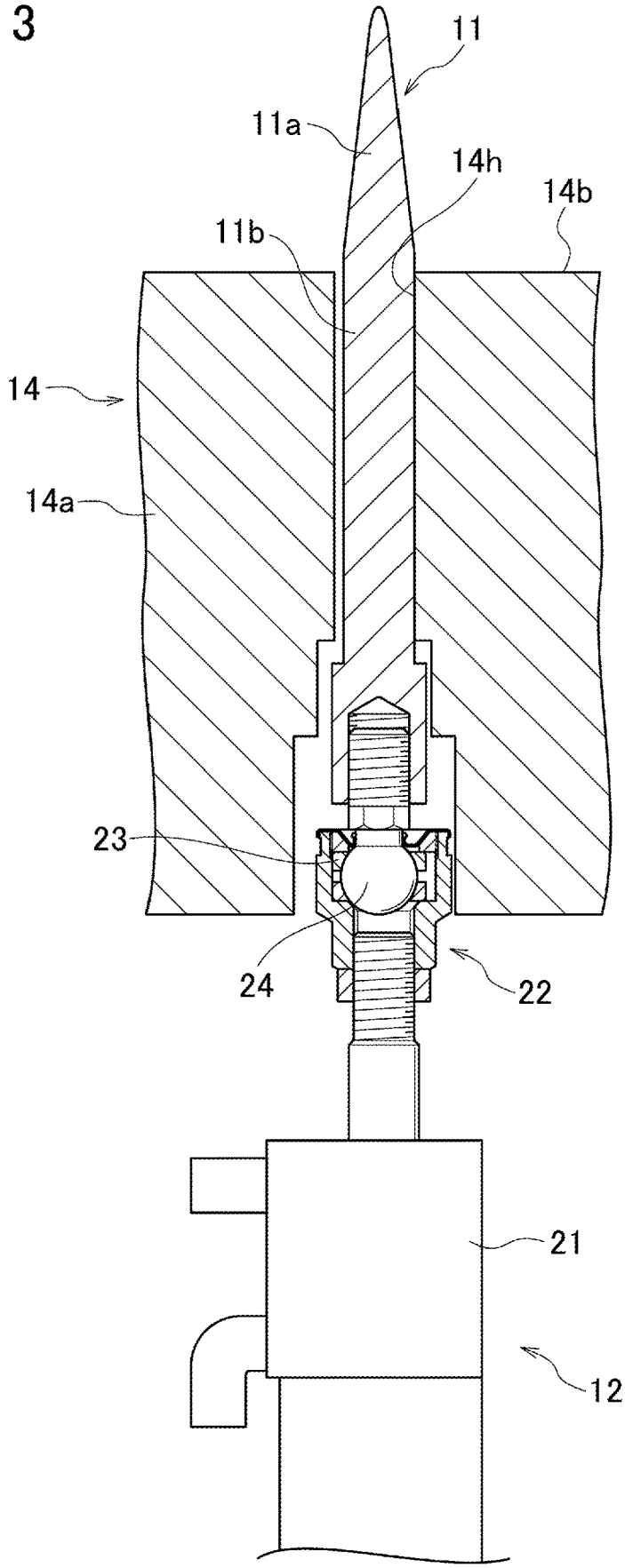
FIG. 3 is a side cross-sectional view showing a main portion of the positioning device for hot stamping in an enlarged manner.

As shown in FIG. 3, the air cylinder 21 of the drive mechanism 12 is mounted to a lower part of the body portion 11*b* of the pilot pin 11, and the air cylinder 21 can slide the pilot pin 11 along the pin guide hole 14*h*.

The lower part of the body portion 11*b* of the pilot pin 11 is connected to the air cylinder 21 through a floating joint 22. That is, the floating joint 22 connects the pilot pin 11 with the air cylinder 21.

Due to heating by the heated plate material 13 and cooling (heat removal) by the press die 14 having a water-cooled pipe or the like, the lower die 14*a* expands and contracts slightly, and the center position of the pin guide hole 14*h* in which the pilot pin 11 slides may deviate slightly. In order to absorb the deviation of the center position of the pin guide hole 14*h*, the floating joint 22 is disposed between the pilot pin 11 and the air cylinder 21.

The floating joint 22 has an eccentric slide mechanism 23 for eccentrically sliding a shaft in plane, and a spherical oscillation mechanism 24 for oscillating the shaft about a spherical surface. As the floating joint 22, for example, one having an allowable eccentric slide amount of 0.75 mm is used.

Operation of Pilot Pin

Hereinafter, a relationship between the operation timing of the pilot pin 11 and the position of the pilot pin 11 in the hot stamping process will be described below with reference to FIGS. 4 to 7.

The plate material (blank material) 13 in which the guide hole 13*h* and other elements have been previously processed is prepared by a normal cold process.

The plate material 13 is an ultrahigh-tension steel sheet for hot stamping such as an aluminum-plated steel sheet or a galvanized steel sheet to which manganese or boron is added for improving hardenability. Aluminum plating or zinc plating is applied to a surface of the steel sheet in order to suppress the generation of oxide scale on the surface of the steel sheet due to oxidation when the steel sheet is conveyed from a heating furnace to a die and to thereby enhance a rust prevention effect after hot stamping.

The plate material 13 is heated in a heating furnace and conveyed to the press die 14 by a conveying roller.

The heated plate material 13 is placed into the press die 14, which is cooled by a water-cooled pipe or the like, by using conveying jaws 15 (see FIG. 2).

As shown in FIG. 4, when the heated plate material 13 is placed into the press die 14, the pilot pin 11 is lifted up to a steady state (projecting position) by the air cylinder 21.

That is, the pilot pin 11 may be lifted up to the projecting position before the heated plate material 13 is placed into the press die 14.

At this time, the pilot pin 11 is lifted up to a position where the boundary section 11*c* between the conical tip portion 11*a* and the cylindrical body portion 11*b* projects about 10 mm from the upper surface 14*b* of the lower die 14*a*.

Figure 5:
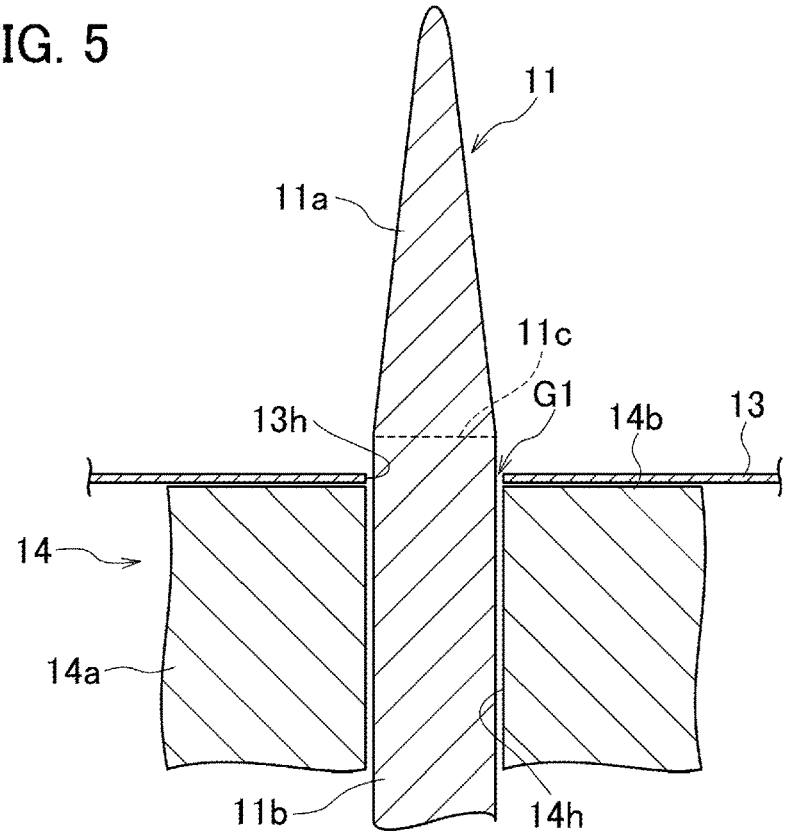
FIG. 5 is a diagram showing a relationship between the hot stamping process and a position of the pilot pin.

As shown in FIG. 5, the heated plate material 13 is placed into the press die 14, and the guide hole 13*h* in the plate material 13 is accurately engaged with the lifted-up pilot pin 11 which is in a steady state.

Subsequently, the plate material 13 placed into the press die 14 is press-formed (hot-stamped) by the press die 14 cooled by using a water-cooled pipe or the like.

The plate material 13*a* press-formed by the press die 14 is held at a bottom dead point for about 10 seconds while being sandwiched between the upper die (not shown) which has been lowered and the lower die 14*a*.

As shown in FIG. 6, at the timing of the start of being held at the bottom dead point, the pilot pin 11 is lowered down to the immersed state (immersed position) by the air cylinder 21.

That is, the pilot pin 11 is lowered down to the immersed position before the process of removing heat by the press die 14 from the plate material 13*a* press-formed by the press die 14.

At this time, the pilot pin 11 is lowered down to a position where the boundary portion 11*c* between the conical tip portion 11*a* and the cylindrical body portion 11*b* is immersed about 5 mm from the upper surface 14*b* of the lower die 14*a*.

As shown in FIG. 7, after the plate material 13 is pressed and is held at the bottom dead point, the press-formed plate material 13*a* is lifted and released by a pin lifter 16 (see FIGS. 1 and 2) together with the rise of the upper die. At this time, the press-formed plate material 13*a* is lifted up about 70 mm from the upper surface 14*b* of the lower die 14*a*.

In a state where the press-formed plate material 13*a* is lifted up by the pin lifter 16, although the diameter of the tip portion 11*a* of the pilot pin 11 is smaller by about 4.0 mm to 6.0 mm than the diameter of the guide hole 13*h* in the press-formed plate material 13*a*, the guide hole 13*h* in the press-formed plate material 13*a* does not come off from the pilot pin 11.

Then, the press-formed plate material 13*a* lifted up by the pin lifter 16 is clamped by the conveying jaws 15 and taken out from the press die 14.

The operation and effect of the present embodiment will be described below.

(1) The positioning device 10 includes the pilot pin 11 provided in the pin guide hole 14*h* in the press die 14, and the driving mechanism 12 for driving the pilot pin 11. Before the plate material 13 is inserted into the press die 14, when the driving mechanism 12 positions the pilot pin 11 at a predetermined projecting position, the tip portion 11*a* of the pilot pin 11 projects from the pin guide hole 14*h* and the body portion 11*b* of the pilot pin 11 formed further toward a base end side than the tip portion 11*a* projects from the pin guide hole 14*h*. Before a process in which the press die 14 removes heat from the plate material 13*a* after having been press-formed by the press die 14, when the driving mechanism 12 positions the pilot pin 11 at a predetermined immersed position, the body portion 11*b* of the pilot pin 11 is immersed in the pin guide hole 14*h* while only the tip portion 11*a* of the pilot pin 11 projects from the pin guide hole 14*h*.

The pilot pin 11 is lowered down to the immersed position before the process of removing heat by the press die 14 from the plate material 13*a* press-formed by the press die 14, thereby preventing the guide hole 13*h* in the press-formed plate material 13*a* which shrinks due to heat removal from biting into the pilot pin 11. On the other hand, in an immersed state of the pilot pin 11, the entire pilot pin 11 is not immersed in the pin guide hole 14*h* of the lower die 14*a* and a part of the tip portion 11*a* of the pilot pin 11 projects from the pin guide hole 14*h*, thereby preventing the press-formed plate material 13*a* from deviating on the press die 14 due to shrinkage caused by heat removal.

(2) The tip portion 11*a* of the pilot pin 11 is formed into a conical shape and the body portion 11*b* of the pilot pin 11 is formed into a cylindrical shape. In the immersed position, the body portion 11*b* formed into a cylindrical shape is immersed in the pin guide hole 14*h* while only the tip portion 11*a* formed into a conical shape projects from pin guide hole 14*h*.

The tip portion 11*a* is formed into a pyramidal shape in order the pilot pin 11 to be easily inserted into the guide hole 13*h* in the plate material 13, and the body portion 11*b* is formed into a cylindrical shape for accurate positioning of the plate material 13 by the pilot pin 11.

(3) The drive mechanism 12 includes the air cylinder 21 for moving the pilot pin 11 along the pin guide hole 14*h*.

The above configuration of the drive mechanism 12 makes it possible to accurately synchronize the movement of the pilot pin 11 performed by the air cylinder 21 with the rise and fall of the upper die of the press die 14.

(4) The drive mechanism 12 includes the floating joint 22 for connecting the pilot pin 11 with the air cylinder 21.

The above configuration of the drive mechanism 12 makes it possible to absorb deviation of the center position of the pin guide hole 14*h* due to heating by the heated plate material 13 and cooling (heat removal) by the press die 14 having a water-cooled pipe or the like.

Although the positioning device for hot stamping of the present invention has been described by way of example in the foregoing embodiment, the present invention is not limited to this embodiment, and various other embodiments can be employed without departing from the gist of the present invention.

What is claimed is:

1. A positioning device for hot stamping, comprising:

a pilot pin provided in a pin guide hole in a press die; and a driving mechanism configured to drive the pilot pin, wherein before a plate material is placed into the press die, when the driving mechanism positions the pilot pin at a predetermined projecting position, a tip portion of the pilot pin projects from the pin guide hole and a body portion of the pilot pin formed further toward a base end side than the tip portion projects from the pin guide hole, and before a process in which the press die removes heat from the plate material after having been press-formed by the press die, when the driving mechanism positions the pilot pin at a predetermined immersed position, the body portion of the pilot pin is immersed in the pin guide hole while only the tip portion of the pilot pin projects from the pin guide hole.

2. The positioning device for hot stamping according to claim 1, wherein the tip portion of the pilot pin is formed into a conical shape and the body portion of the pilot pin is formed into a cylindrical shape, and in the immersed position, the body portion formed into a cylindrical shape is immersed in the pin guide hole while only the tip portion formed into a conical shape projects from the pin guide hole.

3. The positioning device for hot stamping according to claim 1, wherein the drive mechanism includes an air cylinder configured to move the pilot pin along the pin guide hole.

4. The positioning device for hot stamping according to claim 3, wherein the drive mechanism includes a floating joint configured to connect the pilot pin with the air cylinder.

* * * * *